US005090912A

United States Patent [19]

Zell

[11] Patent Number: 5,090,912

[45] Date of Patent: Feb. 25, 1992

[54] ARRANGEMENT FOR THE MECHANICAL AND ELECTRICAL CONNECTION OF A SUPPLEMENTARY PRINTED CIRCUIT BOARD TO A BASE PRINTED CIRCUIT BOARD

[75] Inventor: Karl Zell, Niederpoecking, Fed. Rep. of Germany

[73] Assignee: Siemens Aktiengesellschaft, Munich, Fed. Rep. of Germany

[21] Appl. No.: 749,462

[22] Filed: Aug. 28, 1991

Related U.S. Application Data

[63] Continuation of Ser. No. 522,119, May 11, 1990, abandoned.

[30] Foreign Application Priority Data

May 12, 1989 [JP] Japan ..... 3915648

[51] Int. Cl.[5] ..... H01R 9/09

[52] U.S. Cl. ..... 439/79; 439/80; 439/82

[58] Field of Search ..... 439/65, 76, 78, 79–82, 439/84

[56] References Cited

U.S. PATENT DOCUMENTS 3,264,597 8/1966 Gammel, Sr. ..... 439/80
4,201,432 5/1980 Chalmers ..... 439/82
4,533,203 8/1985 Feldman et al. ..... 439/65
4,776,804 10/1988 Johnson et al. ..... 439/79

*Primary Examiner*—Paula A. Bradley
*Attorney, Agent, or Firm*—Hill, Van Santen, Steadman & Simpson

[57] ABSTRACT

For the electrical connection of the interconnects present at two printed circuit boards to one another, single-piece connector elements are employed that are introduced into a receptacle member that is detachably connected to the supplementary printed circuit board. The one end of each connector element is pressed directly into a plated-through hole of the base printed circuit board and the other end of the connected element is pressed directly into a plated-through hole of the supplementary printed circuit board. The production of this elastic press-in connection in the base printed circuit board or, respectively, the infrequent releasing thereof occurs with the assistance of a mounting element (screw connection) belonging to the receptacle member. The unit composed of the receptacle member and of the supplementary printed circuit board can therefore be continuously moved toward the base printed circuit board or lifted therefrom. Among other things, electrically short passages are achieved for the direct introduction of the connector elements into the plated-through holes and no special pre-forms are needed for such a supplementation or, respectively, retrofitting.

19 Claims, 2 Drawing Sheets

ARRANGEMENT FOR THE MECHANICAL AND ELECTRICAL CONNECTION OF A SUPPLEMENTARY PRINTED CIRCUIT BOARD TO A BASE PRINTED CIRCUIT BOARD

This is a continuation of application Ser. No. 522,119, filed May 11, 1990, now abandoned.

BACKGROUND OF THE INVENTION

1. Field of the Invention

The present invention relates to connection structures and more particularly to an arrangement for mechanically and electrically connecting a supplementary printed circuit board to a base printed circuit board.

2. Description of the Prior Art

It is well known in the art for mechanically and electrically connecting a supplementary printed circuit board also required for retrofitting and referred to as a daughter board to a base printed circuit board, also referred to as a mother board to attach plug-type connectors thereto that, for example, comprise parts of legs of contact spring pairs that are resilient relative to one another as contact locations. The cooperating contact locations situated in an edge of the supplementary printed circuit board are plugged between these legs. It is thereby to assured on the basis of the structural execution that an sufficiently-great retaining force is established.

For those applications wherein it is difficult to let a set of interconnects end directly along a board edge, it is also known to attach correspondingly-adapted plug and receptacle elements to the printed circuit boards to be connected to on another. For the voltaic connection of a plurality of interconnects of the supplementary printed circuit board to a plurality interconnects of the base printed circuit board, these two elements are brought into engagement with one another.

With, for example, the plug-type connector of the German published application 24 40 648, this occurs with resilient parts that are respectively attached in pairs in each plug and receptacle element and that then have their ends pressed solidly into respective, plated holes of the appertaining printed circuit board, whereby a solder connection must then be additionally provided. A majority of the resilient parts utilized in each circuit board are respectively surrounded by a housing, whereby the housings are executed such that they engage into one another and the plug-in connection is produced.

The German published application 19 14 489 discloses that a plurality of specifically-designed contact pieces be introduced in pairs in an insulating housing, their lower parts projecting out of the housing. The part is pressed into the plated-through holes present in the base printed circuit board, being pressed thereinto with an appropriate tool until the housing has its lower wall seated on the printed circuit board. The contact piece is thereby aligned such that the press-in pressure is absorbed by a correspondingly-constructed pressure shoulder. The cooperating contact locations of the supplementary printed circuit board are then plugged into this pre-assembled plug device with the resilient contact locations. Two contact elements separately attached to the two printed circuit boards are thus brought into engagement with this structure.

SUMMARY OF THE INVENTION

The object of the present invention is to provide a simple and cost-effective connection of a supplementary printed circuit board and a base printed circuit board.

The above object is achieved, according to the present invention, in that connector elements constructed of one piece for the voltaic connection of interconnects of the two printed circuit boards to one another together with an insulating receptacle member and the supplementary printed circuit board are joined to form a pluggable unit, in that the connector elements that have their two end regions projecting out of the receptacle member have their other end regions pressed directly into the base printed circuit board in a respective, plated-through hole and are respectively contacted thereto, in that the press-in connection is releasably constructed on the basis of an appropriate shaping of the end region of the connector elements and on the basis of the construction of the contact surface of the bores, in that a mounting element united with the receptacle member are with the base printed circuit board is present for producing or, respectively, for releasing the press-in connection, the pluggable unit being capable of being continuously moved toward the base printed circuit board or lifted off therefrom with the assistance of this mounting element.

The manufacturing expense is reduced in particular by the connector elements constructed of one piece in accordance with the present invention. A significant advantage arises in that no plug connector elements must be pre-formed on the base printed circuit board. The direct connection between the individual connector elements and the plated-through holes applied in the base printed circuit board result in short electrical passages. This is particularly advantageous in bus wirings. The direct, voltaic connection between the connector element and the plated-through hole provided o the base printed circuit board is enabled on the basis of an elastic press-in connection that is produced in a simple manner with the assistance of the integrated mounting element.

Within specific limits for the plugging frequency, the mechanical and electrical connections between the two printed circuit boards can be released with a simple manipulation at the mounting element and the supplementary printed circuit board can be removed. The forces necessary for press-in or, respectively, for releasing the connector elements are produced via the mounting element between the receptacle member and the base printed circuit board without a special tool being required for this purpose, the mounting element representing, for example, a screw element.

According to a particular feature of the invention, the connector elements can comprise an elastic press-in zone at both end regions, whereby one end region of each connector element is then respectively pressed into a corresponding bore of the supplementary printed circuit board and the voltaic connection to the interconnects is thus produced.

According to another feature of the invention, the mounting element with whose assistance the press-in connection is realized is simultaneously utilized as an element for securing the retention between the printed circuit boards. This retention is therefore adequately assured without a special, additional expense. The mounting element can be realized as a screw-tight connection in the most simple manner. A screw-tight connection can therefore be produced and, in turn, released together with a screw nut part introduced in the receptacle member or in the base printed circuit board. A relative longitudinal motion of only the screw element with respect to the other part (receptacle member or, respectively, base printed circuit board) that does not comprise the screw nut part is suppressed by a securing element given unrestricted rotational mobility of the screw element. The bores for the screw nut parts, for example in the form of threaded bushings, can be subsequently attached in a simple manner, as needed.

The arrangement of the connector elements in the receptacle member to be joined with the supplementary printed circuit board to form a pluggable unit can occur in various ways. The receptacle member, according to the present invention, can be composed of a number of parts placed against one another, whereby the parts to be connected to one another fix at least one connector element, preferably a row or connector elements in a middle section between themselves and the respective neighboring part. This can occur in a simple manner with the assistance of, for example, a pock-shaped elevation present in this subregion that respectively engages into a corresponding depression that is present at one of the parts between which it lies. The position of the connector elements can thereby be also additionally secured in that they are placed into a channel that is adapted to their shape and is correspondingly deepened. Dependent on the plurality of required connector elements, therefore, the receptacle member containing the connector elements can be composed in a simple manner in a module fashion. The retention between the individual parts can also occur with a snap-in connection with out employing special connector elements.

Another structural arrangement for joining the required connector elements to the receptacle member is comprised in providing a continuously-open chamber for each connector element in a respective receptacle member constructed of one piece, the connector element being introduced into this continuously-open chamber and having its position outside of the end regions fixed therein due to its shaped and/or due to the cross-sectional shape of the chamber. A number of connector elements corresponding to the respective connection requirements can therefore be provided in a simple manner.

The receptacle member or the parts forming the receptacle member can be manufactured as molded plastic parts.

Given perpendicular attachment of the supplementary printed circuit board to the base printed circuit board, a reliable retention between the parts to be connected results from the receptacle members directly secured in the edge region of the supplementary printed circuit board, resulting via the contact elements to be accommodated therein in a simple manner. The advantage that the interconnects need not be conducted directly up to the edge of the board simultaneously derives.

According to a particular feature of the invention, for the connector elements which have their end regions projecting from the receptacle member with one end region pressed directly into the base printed circuit board in a respective plated-through hole, the other end region of the connector element is respectively introduced into a corresponding bore of the supplementary printed circuit board and the voltaic connection to an interconnect is produced.

According to another feature of the invention, the arrangement is particularly characterized in that the mounting element is simultaneously utilized as an element for securing the cohesion between the pluggable unit and the printed circuit board.

According to another feature of the invention, the arrangement is characterized in that the mounting element is a screw element with which a screw connection can be produced and, in turn, released together with a screw nut part introduced in the receptacle member or in the base printed circuit board, in that a relative longitudinal motion of the screw element with respect to the receptacle member or, respectively, base printed circuit board that does not comprise the screw nut part, is suppressed in each of these events by a securing element given unrestricted rotation mobility of the screw element, as specifically set forth above.

According to another feature of the invention, the arrangement is particularly characterized in that the receptacle member is composed of a plurality of parts placed against one another and connected to one another that fix at least one terminal element in the middle section thereof between those parts and a neighboring part.

According to another feature of the invention, the arrangement is particularly characterized in that the terminal elements are fixed with an elevation or detent joined of one piece with their middle sections that respectively engages into a corresponding recess present at one of the parts between which it lies.

According to another feature of the invention, the arrangement is particularly characterized in that the terminal elements are placed in a groove that is adapted to their shapes and is approximately deepened.

According to another feature of the invention, the arrangement is particularly characterized in that a through chamber is provided for each terminal element in a receptacle member constructed of one piece, the terminal element being introduced into the chamber and having its position outside of the end regions fixed therein by its shape and/or by the cross-sectional shape of the chamber.

According to another feature of the invention, the arrangement is particularly characterized in that the receptacle member over the parts thereof are manufactured as a molded plastic part or parts.

According to another feature of the invention, the arrangement is particularly characterized in that, given a supplementary printed circuit board attached perpendicular relative to base printed circuit board, the receptacle member is secured to the supplementary printed circuit board in the region of an edge thereof at at least one of its sides for forming a pluggable unit, whereby the terminal elements introduced in the receptacle member have their one end regions projecting from the receptacle member and facing away from the printed circuit board respectively bent off at an approximately right angle towards the supplementary printed circuit board.

According to another feature of the invention, the arrangement is particularly characterized in that positioning elements are present for fastening the supplementary printed circuit board to the receptacle member.

According to another feature of the invention, the arrangement is particularly characterized in that the positioning element represents a male member that can be pressed into a corresponding aperture.

According to another feature of the invention, the arrangement is particularly characterized in that the positioning element are attached such that the receptacle member can be secured in a proper position at the one and/or at the opposite lateral surface of the supplementary printed circuit board According to another feature of the invention, the arrangement is particularly characterized in that the ends of the terminal elements are composed of flat material and have a V-shaped or, respectively, C-shaped construction under a collar-shaped broadened portion serving as a pressure shoulder.

According to another feature of the invention, the arrangement is particularly characterized in that the base printed circuit board comprises plated-through holes arranged in a prescribed grid, the holes being provided over the entire board or in a defined surface region thereof.

According to another feature of the invention, the arrangement is particularly characterized in that a plurality of supplementary printed circuit boards are attached to the base printed circuit board.

According to another feature of the invention, the arrangement is particularly characterized in that the base printed circuit board represents a multilayer wiring back plane.

BRIEF DESCRIPTION OF THE DRAWING

Other objects, features and advantages of the invention, its organization, construction and operation will be best understood from the following detailed description, taken in conjunction with the accompanying drawings, on which.

Identical or equivalent components, for example, the printed circuit boards and the connector elements, are provided with identical reference characters in all figures.

DESCRIPTION OF THE PREFERRED EMBODIMENTS

Figure 1:
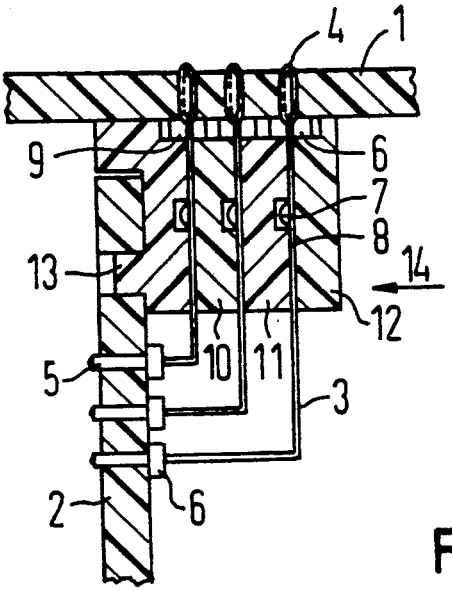
FIG. 1 is a schematic cross-sectional view through a receptacle member containing connector elements, shown after being connected to the printed circuit boards, in accordance with the present invention.

Referring to the drawings, a base printed circuit board or mother board 1 that, for example, represents a multilayer wiring back plane is to be retrofitted or, respectively, supplemented with a supplementary printed circuit board or daughter board 2. Specific interconnects on the two boards are thereby to be then connected to one another. This occurs via a plurality of connector elements 3 which include press-in region at their terminal lugs 4 or, respectively, 5 which are pressed into metallized bores, commonly known as plated-through holes (not shown in detail) of the respective printed circuit board. Each connector element 3 is produced of a flat band material in one piece and has a color-shaped broadened portion 6 in front of the press-in region of the terminal lugs 4, 5 and a press-in tool can be applied to this broadened portion 6 or, respectively, a pre-form can press thereagainst. Three connector elements 3, arranged in different planes, are shown by way of example in FIG. 1, these respectively belonging to a row of such connector elements. The connector elements 3 are introduced into a receptacle member 14 that is composed of a number of parts 9–12 in the exemplary embodiment of FIG. 1. These parts, for example, can be manufactured as molded plastic parts. With the exception of the outermost molded part 12, they have a depression 8 into which, for example, a pock-shaped elevation 7 of the connector element, produced with a coining process engages. A centering and an attitudinally-correct fixing of the connector element are therefore achieved. In addition, the connector element 3 could be placed into a correspondingly-shaped channel. For forming the receptacle member 14 containing the individual connector elements, the individual parts must be joined to one another to form a unit after the introduction of the connector elements 3. In the most simple case, this can occur, for example, with a screwed or riveted connection. It is also conceivable to join the individual parts 9–12 to form a unit with a snap-in connection. This unit representing the receptacle member is, in turn, joined to the printed circuit board 2 that has the circuit supplementations. This could likewise occur with a screw connection or with a riveted connection In order to enable the cohesion of the printed circuit board 2 with the receptacle member 1 composed of a plurality of parts in the exemplary embodiment of FIG. 1, a male member 13 present at the supplementary printed circuit board 2 could also be pressed into a corresponding depression of the first receptacle member part 9. This connection can then be multiply provided.

The one end of each connector element projecting from the multipart receptacle member is bent off out of the plug-in direction with reference to the printed circuit board 1, being bent off perpendicularly toward the printed circuit board 2 and having its respective press-in region respectively pressed into a plated-through hole of the printed circuit board 2. A voltaic or ohmic connection to the interconnects or to defined components present on the printed circuit board are therefore produced. The printed circuit board 2 and the receptacle member containing the individual connector elements form a pluggable unit. With the respective other end of each connector element 3, i.e. with the press-in region of the respective terminal lug 4, this unit can then be pressed into a corresponding, metallized bore or plated-through hole of the printed circuit board 1.

Figure 2:
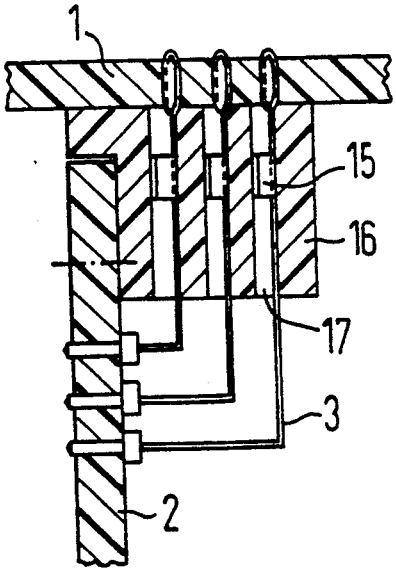
FIG. 2 is a schematic cross-sectional view through a receptacle member containing connector elements, also shown after being joined to the printed circuit boards, according to the present invention.

FIG. 2 illustrates another possibility of designing the receptacle member that accepts the connector elements 3. The receptacle member 16 manufactured as a molded plastic parts contains individual chambers 17 into which the connector elements 3 are inserted arranged in rows. It must then be assured that these connector elements are respectively held in the chambers. To this end, they could, for example, be pinched, pressed or, straddled in.

Figure 3:
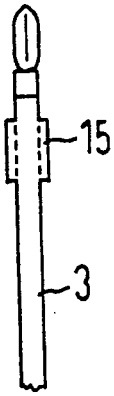
FIG. 3 is a side elevation of a connector element to be utilized in the receptacle member of FIG. 2.

FIG. 3 illustrates an embodiment of such a connector element wherein a U-shaped tab 15 is provided at the connector element. The chamber 17 is therefor formed such that it comprises a constriction so that the inserted connector element 3 seizes at this location. The receptacle member 16 containing the connector elements 3 is joined with the supplementary printed circuit board 2 to form a pluggable unit in the manner set forth above.

Figure 4:
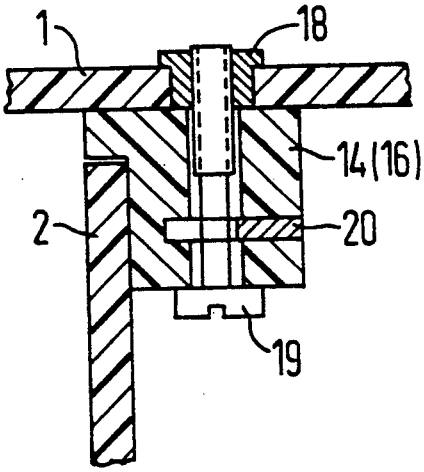
FIG. 4 is a schematic cross sectional view of a mounting element constructed in accordance with the present invention.
Figure 5:
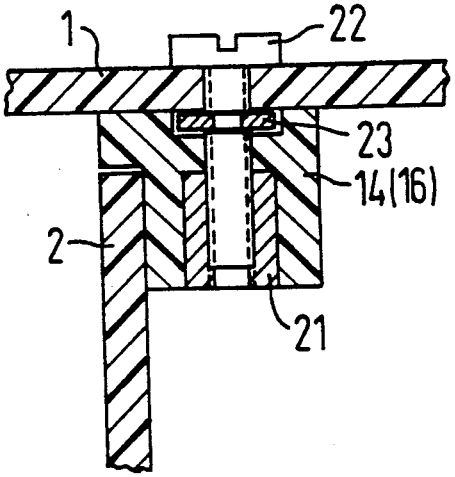
FIG. 5 is a schematic cross sectional view of a mounting element constructed in accordance with the present invention.

As set forth, the connector elements 3 to be fashioned as contact springs can therefore be combined in a receptacle member that, for example, is composed of stackable molded plastic parts or of molded plastic parts that can be snapped onto one another for mutual fastening or that, as a compact molded part, also encompasses several rows of such connector elements. The unit manufactured of the receptacle member and of the supplementary printed circuit board 2 can be effectively joined to the base printed circuit board 1 with the assistance of a mounting element integrated in the receptacle member. Such a mounting element, for example, can be represented by a screw connection with which the forces needed for pressing the pluggable unit in or, respectively, for releasing the pluggable unit are produced. FIGS. 4 and 5 show such a screw connection that, given limited plugging frequency, enables a plugging and a pulling or unplugging of the supplementary printed circuit board 1 in combination with the receptacle member. In the exemplary embodiment of FIG. 4, a threaded bushing 18 is introduced into the base printed circuit board 1. For example, this can occur by pressing the bushing into a corresponding bore. The pulling and plugging of the pluggable unit composed of the receptacle member 14 or, respectively, 16 and of the supplementary printed circuit board 2 is enabled by an appropriate turning of the collar screw 19. A securing clip 20 introduced into the receptacle member 14, 16 is also present so that a back and forth motion of the pluggable unit relative to the base printed circuit board 1 is enabled by turning the collar screw 19 to be introduced into the threaded bushing 18 through the bore in the receptacle member. The securing clip 20 is slotted at one side, whereby the lateral edges of the slot engage into a corresponding groove in the neck of the screw 19. When, given a corresponding rotational motion of the collar screw 19, the pluggable unit moves toward the base printed circuit board 1, then the press-in regions of the terminal lugs 4 of each connector element 3 are pressed into the plated through-holes of the base printed circuit board that are provided in connection positions. For example, the press-in region of each terminal lug can be fashioned V-shaped. The V-shaped press-in region is limited by the collar-shaped broadened portion 6 corresponding to the exemplary embodiment of FIG. 1, for example, the corresponding cut-out area of the molded plastic parts 9–12 that form the receptacle member can then press against the collar-shaped broadened portion. As a result of the aperture angle of the V-shaped press-in region, this is pressed together upon pressing in in the region of the tolerances of the diameters of the bores of the base printed circuit board, whereby a residual resiliency that guarantees a reliable contacting results. The limitations of the respective press-in region can be shaped such that the desired stiffness and stability simultaneously result. When the lateral limitations approaching one another obliquely toward the free end of the terminal lug 4 form a rounded tip, then it is assured that this centrally strikes the bore upon introduction of the terminal lug into the printed circuit board plated-through hole. The unit composed of the supplementary printed circuit board 2 and of the receptacle member 14 or, respectively, 16 is therefore connected to the base printed circuit board 1 with what is referred to as a soft press-in event instead of with a solid press-in event. The press-in into the existing, plated-through holes undertaken with the assistance of the bushing 18 and of the screw 19 can be released again, so that a further retrofitting is possible. This screw connection serves simultaneously for operation and for additional fastening of the unit to the printed circuit board 1. Other than the through contactings, no special pre-formings need be produced on the base printed circuit board 1 for the supplementation thereof by a further, smaller printed circuit board 2. In those instances in which such through contactings serve as what are referred to as transfer contacts, i.e. a freely available, contacted bores, these are already present.

In the exemplary embodiment of FIG. 5, the threaded bushing 21 belonging to the screw connection is pressed into or injected into the receptacle member 14 or, respectively, 16 fashioned according to FIG. 1 or FIG. 2. Given the rotational motion of the screw 22, and in order to enable a plugging or, respectively, a pulling, i.e. a releasing of the unit composed of the supplementary circuit board 2 and of the receptacle member 14 or, respectively, 16, a securing disk 23 has been provided. The securing disk 23, for example, can be fashioned as a snap ring that is snapped into a corresponding groove of the screw.

Figure 6:
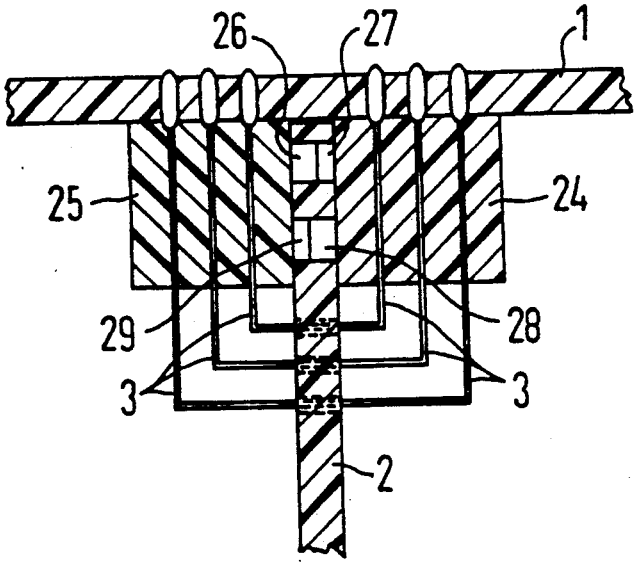
FIG. 6 is a schematic cross sectional view of a two-sided application of a receptacle member in accordance with the present invention.

In the exemplary embodiment of FIG. 6, the pluggable unit is composed of the supplementary printed circuit board 2 and of a total of two receptacle members 25, and, 24. These are respectively arranged at opposite sides of the printed circuit board 2 and can be joined thereto by a press-in connection. This occurs, for example, with the male member 26 or, respectively, 28 that is pressed into the bore 27 or, respectively, 29 of the supplementary printed circuit board 2. However, only one receptacle member can also be alternatively secured to the one or to the other lateral surface of the supplementary printed circuit board 2 in the correct position.

Figure 7:
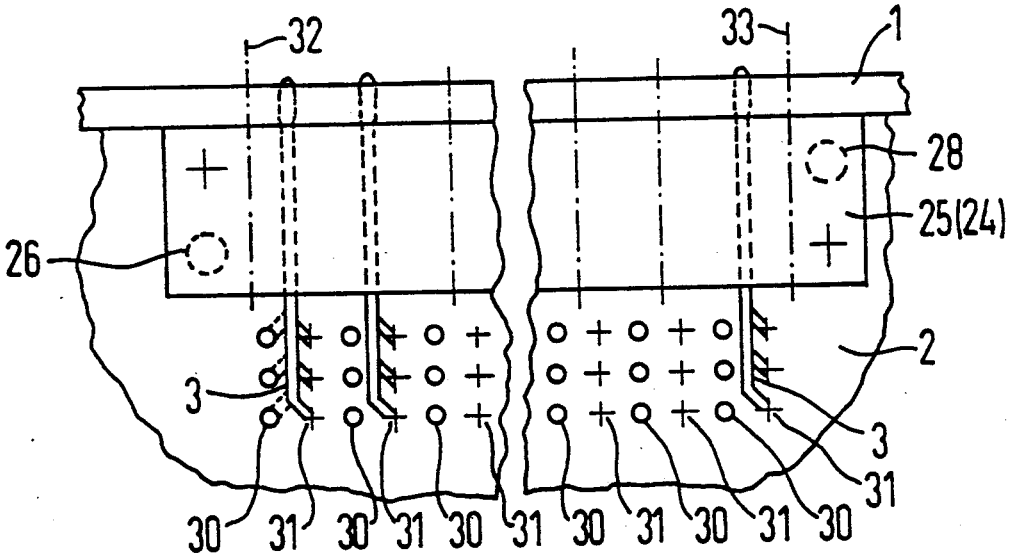
FIG. 7 is a side view of a receptacle member in accordance with the present invention.

It may be derived from the side view of FIG. 7 that the terminal elements 3 lying in succession in each receptacle member 25 or, respectively, 24 are introduced into rows of holes 30 or, respectively, 31 that are respectively offset relative to one another. The male members 26 or, respectively, 28 and the appertaining bores are likewise provided offset relative to one another, so that the respective receptacle member is suitable for what is referred as about-face or reverse mounting. The receptacle member can therefore be attached to the right-hand side and/or to the left-hand side of the supplementary printed circuit board 2 without the terminal elements 3 mutually influencing one another in a disturbing fashion. The screw connection of FIG. 4 or, respectively, FIG. 5 is indicated by the center lines 32 or, respectively, 33 in FIG. 7.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

a pluggable unit comprising first connection means on said receptacle member and second connection means on said supplementary printed circuit board for mating engagement with said first connection means to join said receptacle member and said supplementary printed circuit board;

said pluggable unit plugged into said base printed circuit board, said first and second end regions of said connector elements shaped to accommodate plugging and unplugging and said first regions plugged into and electrically contacting respective plated-through holes of said base printed circuit board; and third connection means mounted on said base printed circuit board; fourth connection means mounted on said receptacle member for releasably securing said pluggable unit to said base printed circuit board;

said third and fourth connection means including means operable to apply plugging and unplugging forces to said receptacle member, said third connection means comprising a thread bushing, said base printed circuit board comprising a bore mounting said threaded bushing, said fourth connection means comprising a screw received in said threaded bushing, and said receptacle member including a bore rotatably mounting said screw.

2. The arrangement of claim 1, wherein:

said screw includes a groove therein; and a snap-in member is mounted in said receptacle member to limit said screw against advancement upon completion of plugging.

3. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

a pluggable unit comprising first connection means on said receptacle member and second connection means on said supplementary printed circuit board for mating engagement with said first connection means to join said receptacle member and said supplementary printed circuit board;

said pluggable unit plugged into said base printed circuit board, said first and second end regions of said connector elements shaped to accommodate plugging and unplugging and said first regions plugged into and electrically contacting respective plated-through holes of said base printed circuit board;

third connection means mounted on said base printed circuit board; fourth connection means mounted on said receptacle member for releasably securing said pluggable unit to said base printed circuit board; and said third and fourth connection means including means operable to apply plugging and unplugging forces to said receptacle member, said third connection means comprising a threaded bushing, said receptacle member comprising a bore mounting said threaded bushing, said fourth connection means comprising a screw receive in said threaded bushing, and said base printed circuit board includes a bore rotatably mounting said screw.

4. The arrangement of clam 3, wherein:

said screw includes a groove therein; and a snap-in member is mounted in said receptacle member to limit said screw against advancement upon completion of plugging.

5. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

a pluggable unit comprising first connection means on said receptacle member and second connection means on said supplementary printed circuit board for mating engagement with said first connection means to join said receptacle member and said supplementary printed circuit board;

said pluggable unit plugged into said base printed circuit board, said first and second end regions of said connector elements shaped to accommodate plugging and unplugging and said first regions plugged into and electrically contacting respective plated-through holes of said base printed circuit board; and third connection means mounted on said base printed circuit board; fourth connection means mounted on said receptacle member for releasably securing said pluggable unit to said base printed circuit board;

said third and fourth connection means each including cooperable threaded means operable to apply plugging and unplugging forces to said receptacle member, and said receptacle member comprising a plurality of parts placed against one another and each connected to the neighboring parts, and adjacent parts including means for fixing at least one of said connector elements therebetween.

6. The arrangement of claim 5, wherein:

each of said parts comprises a recess therein at the location of a connector element; and each of said connector elements comprises a projection extending into a respective recess.

7. The arrangement of claim 5, wherein:

of said parts includes a groove at a location of a connector element which is adapted to the shape of and receives the respective connector element therein.

8. The arrangement of claim 5, wherein:

each of said parts of said receptacle member is a one-piece molded plastic part.

9. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

a pluggable unit comprising first connection means on said receptacle member and second connection means on said supplementary printed circuit board for mating engagement with said first connection means to join said receptacle member and said supplementary printed circuit board;

said pluggable unit plugged into said base printed circuit board, said first and second end regions of said connector elements shaped to accommodate plugging and unplugging and said first regions plugged into and electrically contacting respective plated-through holes of said base printed circuit board; and third connection means mounted on said base printed circuit board; fourth connection means mounted on said receptacle member for releasably securing said pluggable unit to said base printed circuit board;

said third and fourth connection means each including cooperable threaded means operable to apply plugging and unplugging forces to said receptacle member, and said receptacle member comprises passageways therethrough, said connector elements mounted in said passageways.

10. The arrangement of claim 9, wherein:

said passageways each have predetermined cross-sectional dimensions; and said connector elements each have different predetermined cross-sectional dimensions so as to fix said connector elements in said passageways with said first and second end regions fixed at desired locations.

11. The arrangement of claim 9, wherein:

said receptacle member is a one-piece molded plastic part.

12. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

a pluggable unit comprising first connection means on said receptacle member and second connection means on said supplementary printed circuit board for mating engagement with said first connection means to join said receptacle member and said supplementary printed circuit board;

said pluggable unit plugged into said base printed circuit board, said first and second end regions of said connector elements shaped to accommodate plugging andunplugging and said first regions plugged into and electrically contacting respective plated-through holes of said base printed circuit board; and third connection means mounted on said base printed circuit board;

fourth connection means mounted on said receptacle member for releasably securing said pluggable unit to said base printed circuit board;

said third and fourth connection means each including cooperable threaded means operable to apply plugging and unplugging forces to said receptacle member, said receptacle member is mounted at said edge of said supplementary printed circuit board by said first and second connection means, and said second end regions of said connector elements are bent at approximately a right angle towards said supplementary printed circuit board.

13. The arrangement of claim 12, wherein:

said first connection means comprises a male member projecting from said receptacle member; and said second connection means comprises a female recess for receiving said male member in a force fit.

14. The arrangement of claim 12, wherein:

a pair of receptacle members are mounted on opposite sides of said supplementary printed circuit board;

said supplementary printed circuit board comprises said second connection means including a pair of apertures therethrough; and each of said receptacles comprises first connection means including first and second projections of unequal length extending from the respective receptacle member, the total length of said projections equal to the thickness of said supplementary printed circuit board;

said first projections aligned with one another for a force fit and distal end abutment in one said apertures; and said second projections aligned with one another for a force fit and distal end abutment and the other of said apertures.

15. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

first connection means on said receptacle member and second connection means on said supplementary printed circuit board for mating engagement with said first connection means to join said receptacle member and said supplementary printed circuit board into a pluggable unit;

said pluggable unit plugged into said base printed circuit board, said first and second end regions of said connector elements shaped to accommodate plugging and unplugging and said first regions plugged into and electrically contacting respective plated-through holes of said base printed circuit board; and third connection means mounted on said base printed circuit board; fourth connection means mounted on said receptacle member for releasably securing said pluggable unit to said base printed circuit board;

said third and fourth connection means each including cooperable threaded means operable to apply plugging and unplugging forces to said receptacle member, said first and second end regions comprise a shaped distal end, and at least said second end regions each including a color adjacent said shaped distal end.

16. The arrangement of claim 15, wherein:

each of said distal ends comprises a V-shaped structure.

17. The arrangement of claim 15, wherein:

each of said distal ends comprises a C-shaped structure.

18. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

first connection means on said receptacle member and second connection means on said supplementary printed circuit board for mating engagement with said first connection means to join said receptacle member and said supplementary printed circuit board into a pluggable unit;

said pluggable unit plugged into said base printed circuit board, said first and second end regions of said connector elements shaped to accommodate plugging and unplugging and said first regions plugged into and electrically contacting respective plated-through holes of said base printed circuit board;

third connection means mounted on said base printed circuit board; fourth connection means mounted on said receptacle member for releasably securing said pluggable unit to said base printed circuit board; and said third and fourth connection means each including cooperable threaded means operable to apply plugging and unplugging forces to said receptacle member, a plurality of said supplementary printed circuit boards constituted in the same manner as the first-mentioned supplementary printed circuit board, a plurality of said receptacle elements and said connector elements mounted therein and plugged into respective plated-through holes in said base printed circuit board and in respective supplementary printed circuit boards, and a plurality of said first and second connection means mounting said receptacle members and said supplementary printed circuit boards to said base printed circuit board.

19. An arrangement for mechanically and electrically connecting a supplementary printed circuit board, including an edge and printed circuit interconnects and corresponding plated-through holes, to a base printed circuit board including printed circuit interconnects and corresponding plated-through holes thereon, comprising:

an insulating receptacle member;

a plurality of connector elements each including first and second plug-in end regions, said connector elements mounted in rows in said receptacle member with said first and second end regions extending out of said receptacle member;

second end regions of said connector elements plugged into and electrically connected to respective plated-through holes of said supplementary printed circuit board;

a pluggable unit comprising first connection means on said receptacle member and second connection means on said supplementary printed circuit board for mating engagement with said first connection means to join said receptacle member and said supplementary printed circuit board;

said pluggable unit plugged into said base printed circuit board, said first and second end regions of said connector elements shaped to accommodate plugging andunplugging and said first regions plugged into and electrically contacting respective plated-through holes of said base printed circuit board; and third connection means mounted on said base printed circuit board; fourth connection means mounted on said receptacle member for releasably securing said pluggable unit to said base printed circuit board;

said third and fourth connection means each including cooperable threaded means operable to apply plugging and unplugging forces to said receptacle member, said base printed circuit board is a multi-layer back plane structure including said interconnects; and said interconnects thereof are in different layers.

* * * * *